US006361853B1

(12) United States Patent
Shaw-Klein et al.

(10) Patent No.: US 6,361,853 B1
(45) Date of Patent: Mar. 26, 2002

(54) INK JET RECORDING ELEMENT

(75) Inventors: Lori J. Shaw-Klein, Rochester; Eric L. Boyle, Penfield; Brian L. Lindstrom, Stanley, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/467,186

(22) Filed: Dec. 20, 1999

(51) Int. Cl.[7] ..... B41M 5/00
(52) U.S. Cl. ..... 428/195; 347/105
(58) Field of Search ..... 428/195, 478.2, 428/532, 522; 347/105

(56) References Cited

U.S. PATENT DOCUMENTS 5,567,507 A 10/1996 Paff et al.
5,660,928 A 8/1997 Stokes et al.

FOREIGN PATENT DOCUMENTS

| | | |
|---|---|---|
| EP | 545470 | 6/1993 |
| EP | 698502 | 7/1994 |
| EP | 832757 | 4/1997 |
| JP | 61035277 | 2/1986 |

*Primary Examiner*—Pamela R. Schwartz
(74) *Attorney, Agent, or Firm*—Harold E. Cole

(57) ABSTRACT

An ink jet recording element comprising a support having thereon the following layers in the order recited:

a) a hydrophilic absorbing layer comprising gelatin or poly(vinyl alcohol);

b) an adhesion promoting layer comprising pectin or alginate; and c) a hydrophilic overcoat layer comprising hydroxyethyl cellulose.

7 Claims, No Drawings

INK JET RECORDING ELEMENT

FIELD OF THE INVENTION

The present invention relates to an ink jet image-recording element.

BACKGROUND OF THE INVENTION

In a typical ink jet recording or printing system, ink droplets are ejected from a nozzle at high speeds towards a recording element or medium to produce an image on the medium. The recording elements typically comprise a support or a support material having on at least one surface thereof an ink-receiving or image-forming layer. In order to achieve and maintain high quality images on such an image-recording element, the recording element must:

- Exhibit no banding, bleed, coalescence, or cracking in inked areas.
- Exhibit the ability to absorb large amounts of ink and dry quickly to avoid blocking.
- Exhibit high optical densities in the printed areas.
- Exhibit freedom from differential gloss.
- Have high levels of image fastness to avoid fade from contact with water or radiation by daylight, tungsten light, or fluorescent light.
- Have excellent cohesive strength so that delamination does not occur.

U.S. Pat. No. 5,567,507 relates to an ink-receptive sheet containing several layers including a thick base layer and a thinner overcoat comprising a high viscosity cellulose ether and a salt of polyethylene imine. There is a problem with this receiver, however, in that it has poor light fade resistance.

U.S. Pat. No. 5,660,928 relates to an ink jet printing element containing various layers including a hydrophilic layer to prevent fathering. However, there is a problem with this element in that it has reduced gloss and poor light fade resistance.

It is an object of this invention to provide an ink jet recording element which has excellent image quality, less differential gloss, and better light fade resistance than the elements of the prior art.

SUMMARY OF THE INVENTION

These and other objects are achieved in accordance with the invention which comprises an ink jet recording element comprising a support having thereon the following layers in the order recited:

a) a hydrophilic absorbing layer comprising gelatin or poly(vinyl alcohol);

b) an adhesion promoting layer comprising pectin or alginate; and c) a hydrophilic overcoat layer comprising hydroxyethyl cellulose.

Another embodiment of the invention relates to an ink jet printing process comprising:

a) providing an ink jet recording element as described above, and b) applying liquid ink droplets thereon in an image-wise manner.

The ink jet recording element of the invention produces an image which has excellent image quality, less differential gloss, and better light fade resistance than the elements of the prior art.

DETAILED DESCRIPTION OF THE INVENTION

In accordance with the invention, it has been found that a specific combination of image receiving layers, each comprised of specific materials and arranged in a specific sequence on a support material, yields excellent ink jet imaging performance for a wide range of commercially available printing systems.

As noted above, the hydrophilic absorbing layer comprises gelatin or poly(vinyl alcohol) (PA). This layer may also contain other hydrophilic materials such as naturally-occurring hydrophilic colloids and gums such as albumin, guar, xanthan, acacia, chitosan, starches and their derivatives, functionalized proteins, functionalized gums and starches, and cellulose ethers and their derivatives, polyvinyloxazoline, such as poly(2-ethyl-2-oxazoline) (PEOX), polyvinylmethyloxazoline, polyoxides, polyethers, poly(ethylene imine), poly(acrylic acid), poly(methacrylic acid), n-vinyl amides including polyacrylamide and polyvinylpyrrolidone(PVP), and poly(vinyl alcohol) derivatives and copolymers, such as copolymers of polyethylene oxide and poly(vinyl alcohol) (PEO-PVA).

The hydrophilic absorbing layer must effectively absorb both the water and humectants commonly found ink jet printing inks. In a preferred embodiment of the invention, two hydrophilic absorbing layers are present, one comprising gelatin, and the other comprising poly(vinyl alcohol). The hydrophilic materials employed in the image-recording layer may be present in any amount which is effective for the intended purpose. In general, for a two layer structure as described above, the preferred amount of gelatin is from about 5 $g/m^2$ to 15 $g/m^2$; while the preferred amount of poly(vinyl alcohol) is from about 0.5 $g/m^2$ to 3.2 $g/M^2$.

As noted above, the hydrophilic overcoat comprises hydroxyethyl cellulose(HEC). This layer may also contain other hydrophilic materials such as cellulose derivatives, e.g., cellulose ethers like methyl cellulose(MC), ethyl cellulose, hydroxypropyl cellulose(HPC), sodium carboxymethyl cellulose(CMC), calcium carboxymethyl cellulose, methylethyl cellulose, methylhydroxyethyl cellulose, hydroxypropylmethyl cellulose(HPMC), hydroxybutylmethyl cellulose, ethylhydroxyethyl cellulose, sodium carboxymethyl-hydroxyethyl cellulose, and carboxymethylethyl cellulose; and cellulose ether esters such as hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide(HEC-LDME), such as Quatrisoft® LM200 (Amerchol Corp.); as well as hydroxyethyl cellulose grafted with alkyl $C_{12}$–$C_{14}$ chains.

In a preferred embodiment of the invention, the hydrophilic overcoat layer comprises a mixture of hydroxyethyl cellulose and hydroxypropyl methyl cellulose in a weight ratio from about 30:70 to 70:30. The preferred dry coverage of the overcoat layer is from about 0. 5 $g/m^2$ to 1.1 $g/m^2$.

As noted above, there is an adhesion promoting layer between the hydrophilic absorbing layer and hydrophilic overcoat layer comprising pectin or alginate. This layer may also contain other materials such as gelatin, albumin, guar, xanthan, rhamsan, acacia, chitosan, starches and their derivatives, salts of alginic acid; and resins such as poly (vinyl pyrrolidone), and sulfonated polyesters. In the preferred embodiment of the invention, the pectin or alginate used in the adhesion promoting layer is present in an amount from about 0.15 $g/m^2$ to about 0.5 $g/m^2$.

Matte particles may be added to any or all of the layers described in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

Typically, dye mordants are added to ink receiving layers in order to improve water and humidity resistance. However, most mordant materials adversely affect dye light stability. Any polymeric mordant can be used in the image-recording layer of the invention provided it does not adversely affect light fade resistance. For example, there may be used a cationic polymer, e.g., a polymeric quartenary ammonium compound, or a basic polymer, such as poly (dimethylaminoethyl)-methacrylate, polyalkylenepolyamines, and products of the condensation thereof with dicyanodiamide, amine-epichlorohydrin polycondensates; lecithin and phospholipid compounds. Examples of mordants useful in the invention include: vinylbenzyl trimethyl ammonium chloride/ethylene glycol dimethacrylate; vinylbenzyl trimethyl ammonium chloride/divinyl benzene; poly(diallyl dimethyl ammonium chloride); poly(2-N,N,N-trimethylammonium)ethyl methacrylate methosulfate; poly(3-N,N,N-trimethyl-ammonium) propyl methacrylate chloride; a copolymer of vinylpyrrolidinone and vinyl(N-methylimidazolium chloride; and hydroxyethylcellulose derivitized with (3-N,N,N-trimethylammonium)propyl chloride.

Any support or substrate may be used in the recording element of the invention. There may be used, for example, plain or calendered paper, paper coated with protective polyolefin layers, polymeric films such as polyethylene terephthalate, polyethylene naphthalate, poly 1,4-cyclohexane dimethylene terephthalate, polyvinyl chloride, polyimide, polycarbonate, polystyrene, or cellulose esters. In particular, polyethylene-coated paper or poly(ethylene terephthalate) is preferred.

In another embodiment of the invention, a filled layer containing light scattering particles such as titania may be situated between a clear support material and the ink receptive multilayer described herein. Such a combination may be effectively used as a backlit material for signage applications. Yet another embodiment which yields an ink jet receiver with appropriate properties for backlit display applications results from selection of a partially voided or filled poly(ethylene terephthalate) film as a support material, in which the voids or fillers in the support material supply sufficient light scattering to diffuse light sources situated behind the image.

The support is suitably of a thickness of from about 50 to about 500 $\mu$m, preferably from about 75 to 300 $\mu$m. Antioxidants, antistatic agents, plasticizers, dyes, pigments and other known additives may be incorporated into the support, if desired.

In order to improve the adhesion of the image-recording layer to the support, the surface of the support may be subjected to a corona-discharge treatment prior to applying the image-recording layer.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 $\mu$m. Typical binders used in the backing layer are polymers such as acrylates, gelatin, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

While not necessary, the hydrophilic material layers described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, and the like may be used. If a crosslinker is added, care must be taken that excessive amounts are not used as this will decrease the swellability of the layer, reducing the drying rate of the printed areas.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions a re typically water-soluble direct or acid type dyes. Such liquid compositions have been described extensively in the prior art including, for example, U.S. Pat. No. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Receiver Element 1 of the Invention (HEC)

A polyethylene resin coated paper was treated by corona discharge and coated with a 10% gelatin solution in water, photographic grade lime process ossein gelatin (Eastman Gelatine Co.), by conventional bead coating and then dried to form a continuous gelatin film of dry coverage of 10.8 g/m$^2$. In another bead coating pass, an adhesion promoting material, pectin, Genu® USP/200 (Hercules Inc.), and a overcoat layer of hydroxyethyl cellulose, Cellosize QP300 (Union Carbide Corporation) were coated over the gelatin. The hydroxyethyl cellulose was coated from a 1.75% solids solution in water to yield a dry layer coverage of 0.9 g/m$^2$, while the pectin layer was coated from a 0.075% solids solution to yield a dry layer coverage of 0.3 g/m$^2$. The pectin layer and overcoat layer were dried thoroughly by forced air heat.

Control Element 1 (MC)

This element was the same as Receiver Element 1 of the Invention except that the hydrophilic overcoat layer was methyl cellulose, Methocel® A4C (Dow Chemical Co.).

Control Element 2 (HPC)

This element was the same as Receiver Element 1 of the Invention except that the hydrophilic overcoat layer was hydroxypropyl cellulose, Klucel® L, (Hercules Inc.).

Control Element 3 (HPMC)

This element was the same as Receiver Element 1 of the Invention except that the hydrophilic overcoat layer was hydroxypropylmethyl cellulose, Methocel® K100LV (Dow Chemical Co.).

Control Element 4 (HEC-LDME)

This element was the same as Receiver Element 1 of the Invention except that the hydrophilic overcoat layer was an ester of hydroxyethyl cellulose and a lauryl dimethyl ammonium substituted epoxide, Quatrisoft® LM200, (Amerchol Corp.).

Control Element 5 (CMC)

This element was the same as Receiver Element 1 of the Invention except that the hydrophilic overcoat layer was carboxymethyl cellulose, Celfix® 5, (Metsa Specialty Chemical Co.).

Differential Gloss Measurement

When variously colored areas of an image exhibit significantly different gloss from each other or from the unprinted areas, a distracting noticeable differential gloss is apparent. In order to quantify this effect, patches of 100% fill were printed for each primary color (cyan, magenta, yellow and black), as well as each secondary color (red, green and blue) using a Hewlett Packard DesignJet 2500 CP Wide Format Printer using Dye-based HP DesignJet CP Ink Systems HPC1806A Black, HPC1807A Cyan, HPC1808A Magenta and HPC1809A Yellow. The gloss of each patch was measured at a 60 degree angle from the perpendicular to the plane of the paper for each color patch as well as the unprinted area using a BYK Gardner Microgloss Meter. The biggest difference between any two readings for a given printed sample was recorded in Table 1 as differential gloss. Lower values of differential gloss are preferred.

Ink Cracking Test

A 100% black area was printed using a Hewlett-Packard 722 ink jet printer using the HP Large Black Inkjet Cartridge 51645A by selecting a driver setting which yields a pure, pigmented black. Each black patch was inspected using a magnifier and categorized as follows:

1: no cracking
2: cracking visible only with 30x magnification
3: cracking barely visible without magnification
4: cracking easily visible without magnification A rating of 1 or 2 is acceptable for ink cracking. The following results were obtained:

TABLE 1

| Element | Differential Gloss | Ink Cracking |
|---|---|---|
| 1 | 22 | 2 |
| Control 1 | 35 | 3 |
| Control 2 | 33 | 4 |
| Control 3 | 31 | 4 |
| Control 4 | 39 | 1 |
| Control 5 | 73 | 1 |

The above results show that the element of the invention had better differential gloss than the control elements and acceptable ink cracking.

Example 2

Receiver Element 2 of the Invention (PVA)

This element is the same as Receiver Element 1 of the Invention except that the hydrophilic absorbing layer was poly(vinyl alcohol), Elvanol® 52-22, (DuPont Co.)

Control Element 6 (PVP)

This element was the same as Receiver Element 1 of the Invention except that the hydrophilic absorbing layer was poly(vinyl pyrrolidone), K90 (International Specialty Products Technologies Inc.).

Control Element 7 (PEO-PVA)

This element was the same as Receiver Element 1 of the Invention except that the hydrophilic absorbing layer was a polyethylene oxide-poly(vinyl alcohol) copolymer, WO-320 (Nippon Gohsei).

Control Element 8 (PEOX)

This element was the same as Receiver Element 1 of the Invention except that the hydrophilic absorbing layer was poly (2-ethyl-2-oxazoline), Aquazol® 200 (Polymer Chemistry Innovations, Inc.).

Light Fade Testing

Light fade resistance was measured by printing solid red (R), green (G) and blue (B) patches using the Hewlett Packard 2500 printer and inks described above and exposing to 50 KLux high intensity daylight radiation for seven days. The ratio of the components of each optical density after and before radiation can be multiplied by 100 to yield per cent retained optical density. The retained optical densities for each channel are tabulated below; for example C of G indicates the % retained cyan density in the green patch, M of R represents the % retained magenta density in the red patch, etc. Higher retained optical density numbers are better. The following results were obtained:

TABLE 2

| | (% Retained Optical Density) | | | | | |
|---|---|---|---|---|---|---|
| Element | M of R | Y of R | C of G | Y of G | M of B | C of B |
| 1 | 100 | 99 | 98 | 96 | 84 | 99 |
| 2 | 97 | 99 | 97 | 98 | 86 | 99 |
| Control 6 | 94 | 97 | 46 | 96 | 87 | 51 |
| Control 7 | 95 | 98 | 93 | 99 | 59 | 101 |
| Control 8 | 96 | 101 | 92 | 100 | 53 | 94 |

The above results show that the elements of the invention have superior resistance to light-induced fading than the control elements.

Example 3

Receiver Element 3 of the Invention (Alginate)

This element was the same as Receiver Element 1 of the Invention except that the adhesion promoting material, pectin, was replaced by alginate, the sodium salt of alginic acid, medium molecular weight (Sigma-Aldrich Co.).

Control Element 9 (none)

This element was the same as Receiver Element 1 of the Invention except that there was no adhesion promoting material.

Control Element 10 (PVP)

This element was the same as Receiver Element 1 of the Invention except that the adhesion promoting material, pectin, was replaced by poly(vinyl pyrrolidone), K90 (International Specialty Products Technologies Inc.).

Control Element 11 (PVA)

This element was the same as Receiver Element 1 of the Invention except that the adhesion promoting material, pectin, was replaced by poly(vinyl alcohol), Elvanol® 52-22, (DuPont Co.).

Adhesion Test

In order to test the adhesive effect of each adhesion promoting material, a crosshatch pattern was lightly scored on the surface of each sample using a razor blade and conventional adhesive tape was applied in an attempt to remove material from the cut area. The test was run on samples at a low humidity (27%) and at a high humidity (80%). An estimate of per cent of coated material under the tape which could be removed by pulling was made for each sample. The following results were obtained:

TABLE 3

| Element | Adhesion promoting material | % removed at 27% RH | % removed at 80% RH |
|---|---|---|---|
| 1 | Pectin | 0 | 0 |
| 3 | Alginate | 0 | 50 |
| Control 9 | None | 100 | 100 |
| Control 10 | PVP | 75 | 75 |
| Control 11 | PVA | 50 | 50 |

The above results show that the elements containing pectin and alginate are better than the control elements at low and high relative humidity.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon the following layers in the order recited:

a) a hydrophilic absorbing layer comprising gelatin or poly(vinyl alcohol);

b) an adhesion promoting layer comprising pectin or alginate; and c) a hydrophilic overcoat layer comprising hydroxyethyl cellulose.

2. The recording element of claim 1 wherein there is an additional hydrophilic absorbing layer between a) and b).

3. The recording element of claim 1 wherein said hydrophilic absorbing layer is present in an amount of from about 5 to about 15 $g/m^2$.

4. The recording element of claim 1 wherein said adhesion promoting layer is present in an amount of from about 0.15 to about 0.5 $g/m^2$.

5. The recording element of claim 1 wherein said hydrophilic overcoat layer also contains hydroxypropylmethyl cellulose.

6. The recording element of claim 1 wherein said hydrophilic overcoat layer is present in an amount of from about 0.5 to about 1.1 $g/m^2$.

7. An ink jet printing process comprising:

a) providing an ink jet recording element according to claim 1, and b) applying liquid ink droplets thereon in an image-wise manner.

* * * * *